US007370580B2

(12) United States Patent
Görbing et al.

(10) Patent No.: US 7,370,580 B2
(45) Date of Patent: May 13, 2008

(54) CONTROL ROLLER HAVING SPEED-DEPENDENT PRESSING FORCE

(75) Inventors: Christian Görbing, Heidelberg (DE); Thomas Schmidt, Eppelheim (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 360 days.

(21) Appl. No.: 11/053,992

(22) Filed: Feb. 9, 2005

(65) Prior Publication Data

US 2005/0211122 A1 Sep. 29, 2005

(30) Foreign Application Priority Data

Mar. 26, 2004 (DE) ..... 10 2004 014 868

(51) Int. Cl.
*B41F 1/30* (2006.01)

(52) U.S. Cl. ..... 101/408; 101/409; 101/475; 271/277

(58) Field of Classification Search ..... None
See application file for complete search history.

(56) References Cited

U.S. PATENT DOCUMENTS

| | | | | |
|---|---|---|---|---|
| 2,926,909 A | | 3/1960 | Jantzen | |
| 3,257,109 A | * | 6/1966 | Singh | 271/268 |
| 3,563,536 A | * | 2/1971 | Hanzlik | 271/277 |
| 3,929,069 A | * | 12/1975 | Jahn | 101/232 |
| 4,135,198 A | * | 1/1979 | Fujimoto | 271/277 |
| 5,516,096 A | * | 5/1996 | Whiteside et al. | 271/277 |
| 6,701,840 B2 | | 3/2004 | Hawkes | |
| 2003/0132573 A1 | | 7/2003 | Becker et al. | |

FOREIGN PATENT DOCUMENTS

| | | |
|---|---|---|
| CH | 410 022 | 10/1966 |
| CH | 430 762 | 8/1967 |
| DE | 199 56 369 A1 | 5/2001 |
| DE | 101 03 042 A1 | 8/2001 |
| DE | 102 48 974 A1 | 5/2003 |
| DE | 102 58 271 A1 | 7/2003 |

* cited by examiner

*Primary Examiner*—Jill E. Culler
(74) *Attorney, Agent, or Firm*—Laurence A. Greenberg; Werner H. Stemer; Ralph E. Locher

(57) ABSTRACT

In an apparatus for adapting the pressing force of a control roller on a control can in a sheet-processing machine by a torsion spring, the apparatus either changes the effective spring length or the spring stiffness as a function of the rotational speed of the sheet-processing machine. The spring can be a torsion spring rod with an actuator setting the spring force by changing the prestress. A stiffening element can be connected to the torsion spring rod and set the spring force by changing the spring stiffness of the torsion spring rod.

13 Claims, 6 Drawing Sheets

CONTROL ROLLER HAVING SPEED-DEPENDENT PRESSING FORCE

BACKGROUND OF THE INVENTION

Field of the Invention

The present invention relates to an apparatus for adapting the pressing force of a control roller on a control cam in a sheet-processing machine.

In, for example, roller-controlled gripper devices in sheet-fed rotary presses, there is a problem that the control rollers provided for controlling the grippers, for example, are subjected to very high forces, in particular, at higher processing speeds and, therefore, high rotational speeds, which forces lead to the control rollers lifting off the control cams. This results in undefined gripper movement and increased wear of the control rollers. As a rule, this problem can be countered by the pressing forces of the control rollers on the control cams being matched to the highest processing speed.

German Published, Non-Prosecuted Patent Application DE 199 56 369 A1 shows a gripper of a sheet-processing machine that is controlled by a control roller that interacts with a control cam. The pressing force of the control roller on the control cam can be set manually. However, the result of this is that a high setting of pressing forces is also very high at low and medium processing speeds, and, therefore, the control rollers and also the control cam are subject to increased wear.

SUMMARY OF THE INVENTION

It is accordingly an object of the invention to provide a speed-dependent pressing force that overcomes the hereinafore-mentioned disadvantages of the heretofore-known devices of this general type and that permits automatic adaptation of the pressing force of control rollers and control cam to different operating conditions.

With the foregoing and other objects in view, there is provided, in accordance with the invention, an apparatus for adapting a pressing force of a control roller on a control cam, including a prestressed spring having a force, the force of the spring to be set as a function of a rotational speed of a sheet-processing machine.

With the objects of the invention in view, there is also provided an apparatus for adapting a pressing force of a control roller on a control cam, including a prestressed spring having a force, the force of the spring to be regulated as a function of the pressing force between the control roller and the control cam.

It is a particular advantage of the invention that the service lives of the elements involved in the gripper control, such as control rollers and/or control cams, are increased.

In accordance with another feature of the invention, provision is made to increase the prestressing force of a spring that produces the pressing force as a function of rotational speed, for example, by prestressing a torsion spring. The actuating devices provided are actuating measures that can be driven hydraulically, pneumatically, magnetically, or electrically.

Further advantageous refinements relate to the configuration of speed-dependent pressure generators for supplying the actuating elements. In such a case, for example, a pressure generator or, else, a speed-controlled swash plate pump or a pressure transformer operating with centrifugal force can be provided.

In accordance with a further feature of the invention, an electric pump is driven as a function of the rotational speed of the sheet-processing machine, for example, by the control computer.

In accordance with an added feature of the invention, the pressing force is adapted by changing the spring rate or spring stiffness of the gripper system, for example, when a torsion spring is used, by increasing the spring stiffness by changing the length of the twistable proportion of the torsion spring as a function of the machine rotational speed by the form-fitting connection to a displaceable element.

In accordance with an additional feature of the invention, provision is made to configure the elements that have elasticity in a manner that saves overall space by connecting them in parallel.

In accordance with yet another feature of the invention, provision is made to control the adaptation of the pressing force of the spring system as a function of the actual pressing force between control roller and control cam, for example, measured by strain gages.

In accordance with yet a further feature of the invention, the spring is a torsion spring rod having a prestress and an actuator is connected to the torsion spring rod and sets the spring force by changing the prestress of the torsion spring rod.

In accordance with yet an added feature of the invention, the spring is a torsion spring rod having a spring force and a spring stiffness and a stiffening element is connected to the torsion spring rod and sets the spring force by changing the spring stiffness of the torsion spring rod.

In accordance with yet an additional feature of the invention, the stiffening element has a holder surrounding the torsion spring rod and the holder is secured against rotation and displaced axially.

In accordance with again another feature of the invention, there is provided an actuating motor connected to the stiffening element and displacing the stiffening element along the torsion spring rod.

In accordance with again a further feature of the invention, the torsion spring rod is a plurality of torsion spring rods operatively connected in parallel with one another and the control roller is part of a cam-controlled gripper system in which the torsion spring rod, applies the pressing force.

In accordance with again an added feature of the invention, a gear wheel coupling operatively connecting the torsion spring rods to one another.

In accordance with again an additional feature of the invention, there is provided an actuator connected to at least one of the torsion spring rods for rotating the at least one of the torsion spring rods.

In accordance with still another feature of the invention, the actuator has a hydraulically actuated operating cylinder.

In accordance with still a further feature of the invention, the operating cylinder has an operating chamber and a stationary pump to be driven by a control computer as a function of the rotational speed of the sheet-processing machine is pressurizes the operating chamber.

In accordance with still an added feature of the invention, there are provided a cylinder bearing the torsion spring rod, the operating cylinder having an operating chamber, and a hydraulic pump pressurizing the operating chamber and being driven by the cylinder bearing the torsion spring rod.

In accordance with still an additional feature of the invention, a first feed line connects the pump to the operating chamber, an oil reservoir is fixed to the cylinder bearing the torsion spring rod, a second feed line connects the pump to the oil reservoir, and a restrictor connects the first feed line to the second feed line.

With the objects of the invention in view, in a sheet-processing machine operating with a rotational speed and having a control roller and a control cam, there is also provided an apparatus for adapting a pressing force of the control roller on the control cam, including a prestressed spring having a force, the force of the spring being set as a function of the rotational speed of the sheet-processing machine.

With the objects of the invention in view, there is also provided a sheet-processing machine, including a sheet-processing assembly operating with a rotational speed, the sheet-processing assembly having a control roller and a control cam, the control roller contacting the control cam with a pressing force, and an apparatus for adapting the pressing force of the control roller on the control cam, the adapting apparatus having a prestressed spring having a force, the force of the spring being set as a function of the rotational speed of the sheet-processing assembly.

With the objects of the invention in view, in a sheet-processing machine having a control roller and a control cam, there is also provided an apparatus for adapting a pressing force of the control roller on the control cam, including a prestressed spring having a force, the force of the spring being regulated as a function of the pressing force between the control roller and the control cam.

With the objects of the invention in view, there is also provided a sheet-processing machine, including a sheet-processing assembly having a control roller and a control cam, the control roller contacting the control cam with a pressing force, and an apparatus for adapting the pressing force of the control roller on the control cam, the adapting apparatus having a prestressed spring having a force, the force of the spring being regulated as a function of the pressing force between the control roller and the control cam.

Other features that are considered as characteristic for the invention are set forth in the appended claims.

Although the invention is illustrated and described herein as embodied in a speed-dependent pressing force, it is, nevertheless, not intended to be limited to the details shown because various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawings.

DESCRIPTION OF THE PREFERRED EMBODIMENTS

Figure 1:
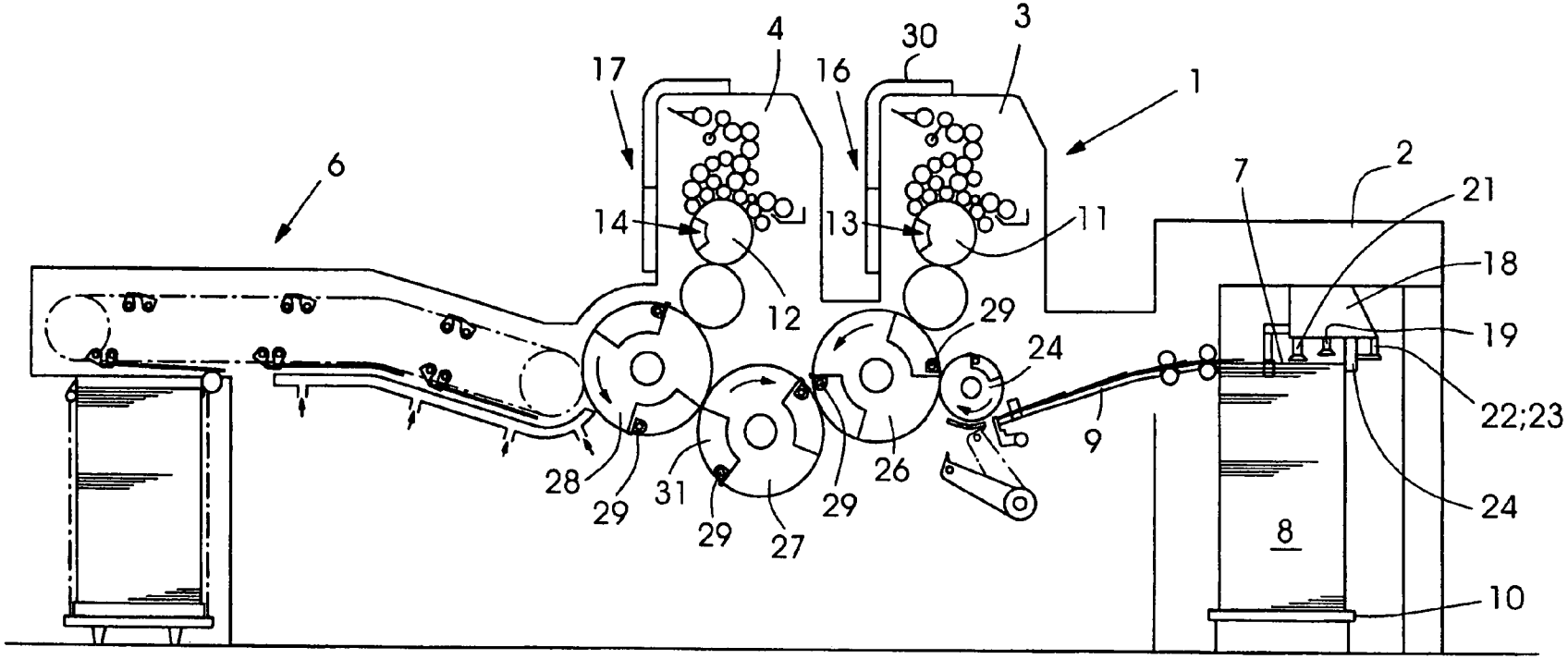
FIG. 1 is a diagrammatic cross-sectional view of a sheet-processing rotary press according to the invention.

Referring now to the figures of the drawings in detail and first, particularly to FIG. 1 thereof, there is shown a machine 1 that processes sheets 7, for example, a press, having a deliverer 2 (also referred to as a delivery), at least one printing unit 3 and 4 and a deliverer 6. The sheets 7 are taken from the sheet stack 8 and, separated or overlapping, are supplied over a feed table 9 to the printing units 3 and 4. The units 3, 4 each contain a plate cylinder 11, 12 in the known way. The plate cylinders 11, 12 each have an apparatus 13, 14 for fixing flexible printing plates. Furthermore, each plate cylinder 11, 12 is associated with an apparatus 16, 17 for the semiautomatic or fully automatic printing plate change.

The sheet stack 8 rests on a stack board 10 that can be raised under control. The sheets 7 are removed from the top side of the sheet stack 8 by what is referred to as a suction head 18 that, inter alia, has a number of lifting and dragging suckers 19, 21 for separating the sheets 7. Furthermore, blower devices 22 are provided for loosening the upper layers of sheets, and sensing elements 23 for tracking the stack. To align the sheet stack 8, in particular, the upper sheets 7 of the sheet stack 8, a number of lateral and rear stops 24 are provided.

The sheets are transported through the sheet-processing machine by gripper systems 29 disposed on the transport cylinders 24, 26, 27, 28. The construction of these gripper systems is substantially the same and will, therefore, be described only by using the transfer cylinder 27.

Figure 2:
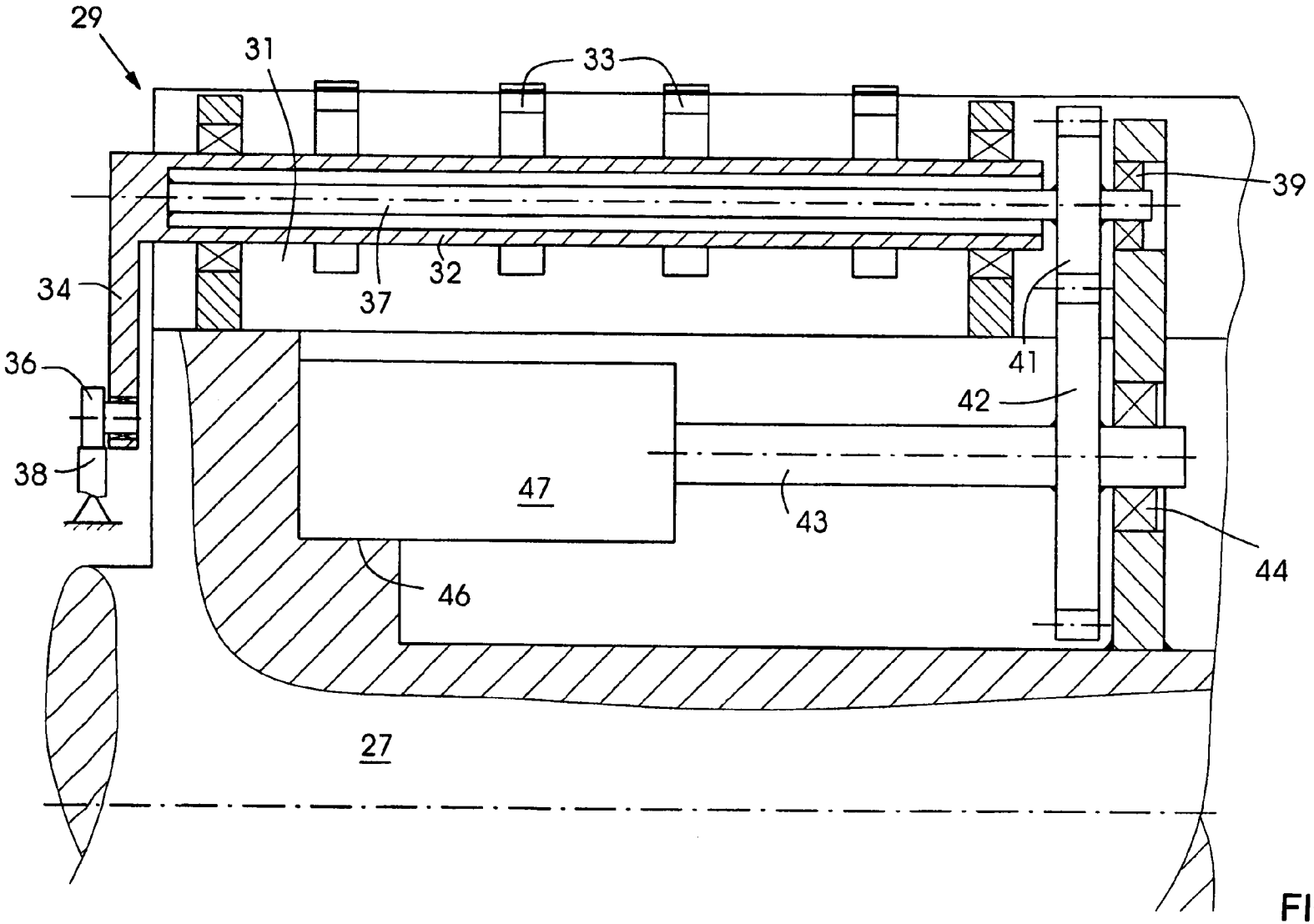
FIG. 2 is a fragmentary, diagrammatic, cross-sectional view of a sheet-transporting cylinder.

FIG. 2 shows a gripper bar, as it is known, which is mounted such that it can be pivoted in a cylinder channel 31 of the transfer cylinder 27. The gripper bar substantially includes a gripper tube 32 that carries a number of grippers 33 disposed beside one another at intervals. At its first end, the gripper tube 32 bears a control lever 34 for a control roller 36 that, under the force of a torsion spring 37, is in operating contact with a control cam 38 configured to be stationary. The torsion spring 37 is a torsion spring rod that is surrounded coaxially by the gripper tube 32 and, at the end facing the control roller 36, is firmly connected to the gripper tube 32. At the other end, the torsion spring 37 projects out of the gripper tube 32 and, between a bearing point 39 for the torsion spring rod 37 and the gripper tube 32, bears a gear wheel 41.

The gear wheel 41 meshes with a further gear wheel 42, which is fixed to a second torsion spring 43 and, in particular, a torsion spring rod, disposed parallel to the first. The second torsion spring 43 has a first rotatable mounting 44 and, on the opposite side, a fixed clamping device 46.

The second torsion spring 43 bears an actuator 47 that can be driven as a function of the rotational speed of the sheet-processing machine and can be actuated accordingly, which effects twisting of the two torsion spring rods 37 and 43. The torsion spring rods 37, 43 are installed such that they are stressed with respect to each other so that the control roller 36 is pressed with slight pressure against the control cam 38 when the machine is at a standstill. As the rotational speed increases, the actuator 47 brings about twisting of the torsion spring 43 and, thus, through the gear wheel connection 42, 41, twisting of the torsion spring 37 and, respectively, a higher pressing force of the control roller 36 on the control cam 38.

The actuator 47 operates electrically, magnetically, pneumatically, or, preferably, hydraulically.

Figure 2A:
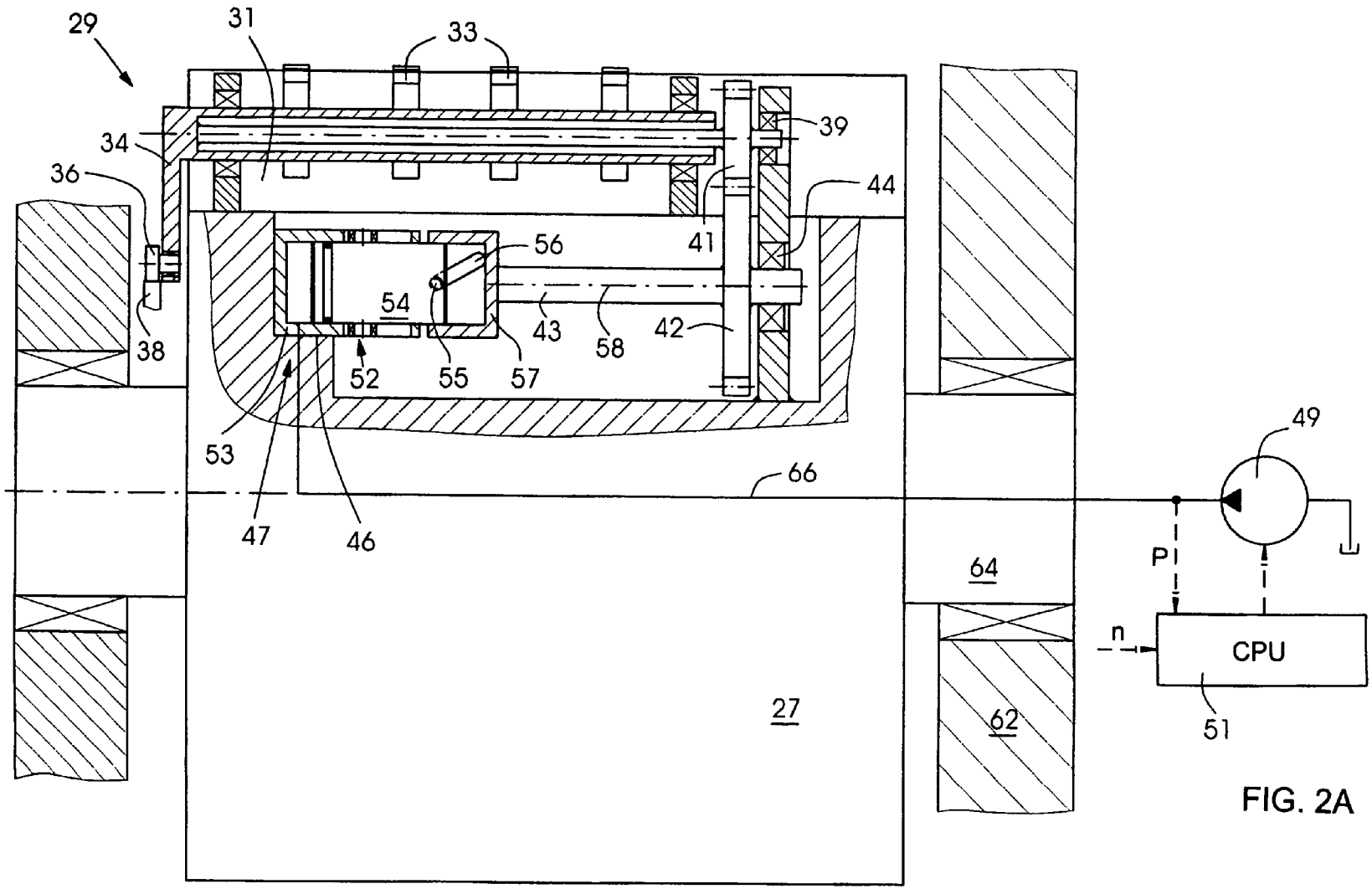
FIG. 2A is a partially block circuit and partially cross-sectional view of a first exemplary embodiment for driving a hydraulic actuator according to the invention.
Figure 2B:
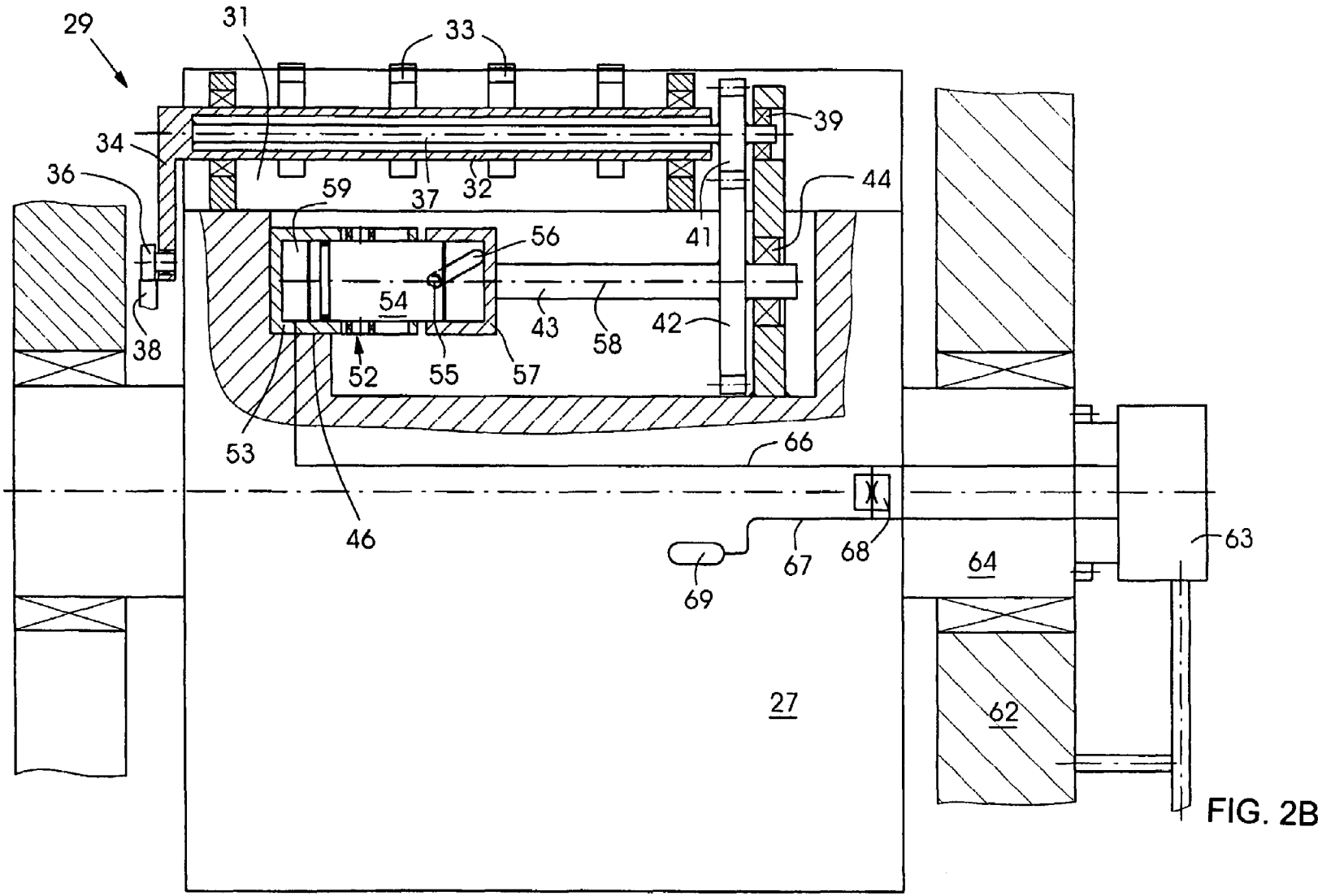
FIG. 2B is a diagrammatic cross-sectional view of a second exemplary embodiment for driving the hydraulic actuator according to the invention.

For such a purpose, as illustrated in FIG. 2A, an externally disposed hydraulic pump 49 that can be driven electrically is provided that, as a function of rotational speed from the control computer 51 of the sheet-processing machine, pressurizes the actuator 47 through, for example, a rotary leadthrough. As illustrated in FIGS. 2A and 2B, the actuator 47 substantially includes an operating cylinder 52, whose cylinder body 53 is fixed to the cylinder 27 at the mounting position of the fixed clamping device 46. The operating cylinder 52 has a piston 54 that is fixed against rotation in its cylinder body and that, by a pin 55, engages in an oblique groove 56 in a second cylinder 57. The second cylinder 57 is connected to the torsion spring rod 43 such that the axis 58 of the torsion spring 43 is identical to the mid-axis 58 of the operating cylinder 53. Loading the operating chamber 59 (see FIG. 2B) formed between the cylinder body 53 and piston 54 leads to a translation or displacement of the piston 54 and twisting of the second cylinder 57 and of the torsion spring rod 43, produced through the pin 55 and inclined groove 56.

A further possible way of driving or pressurizing the actuator 47, in particular, the operating cylinder 52, is shown by FIG. 2B. An axial piston pump 63 disposed in a stationary manner on a frame wall 62 of the sheet-processing machine 1 is driven by the rotation of the cylinder journal 64 (for example, drive of the swash plate) and supplies the operating cylinder 52 through a line 66 with an operating medium, preferably, hydraulic oil. A second line 67 connects a hydraulic oil reservoir 69 disposed in the cylinder 27 to the axial piston pump 63. The lines 66, 67 are connected to a line in which a restrictor 68 is incorporated. The volume flow delivered by the pump 63 produces a back-pressure region upstream of the restrictor 68, the back-pressure region being used to drive the operating cylinder 53.

Figure 3:
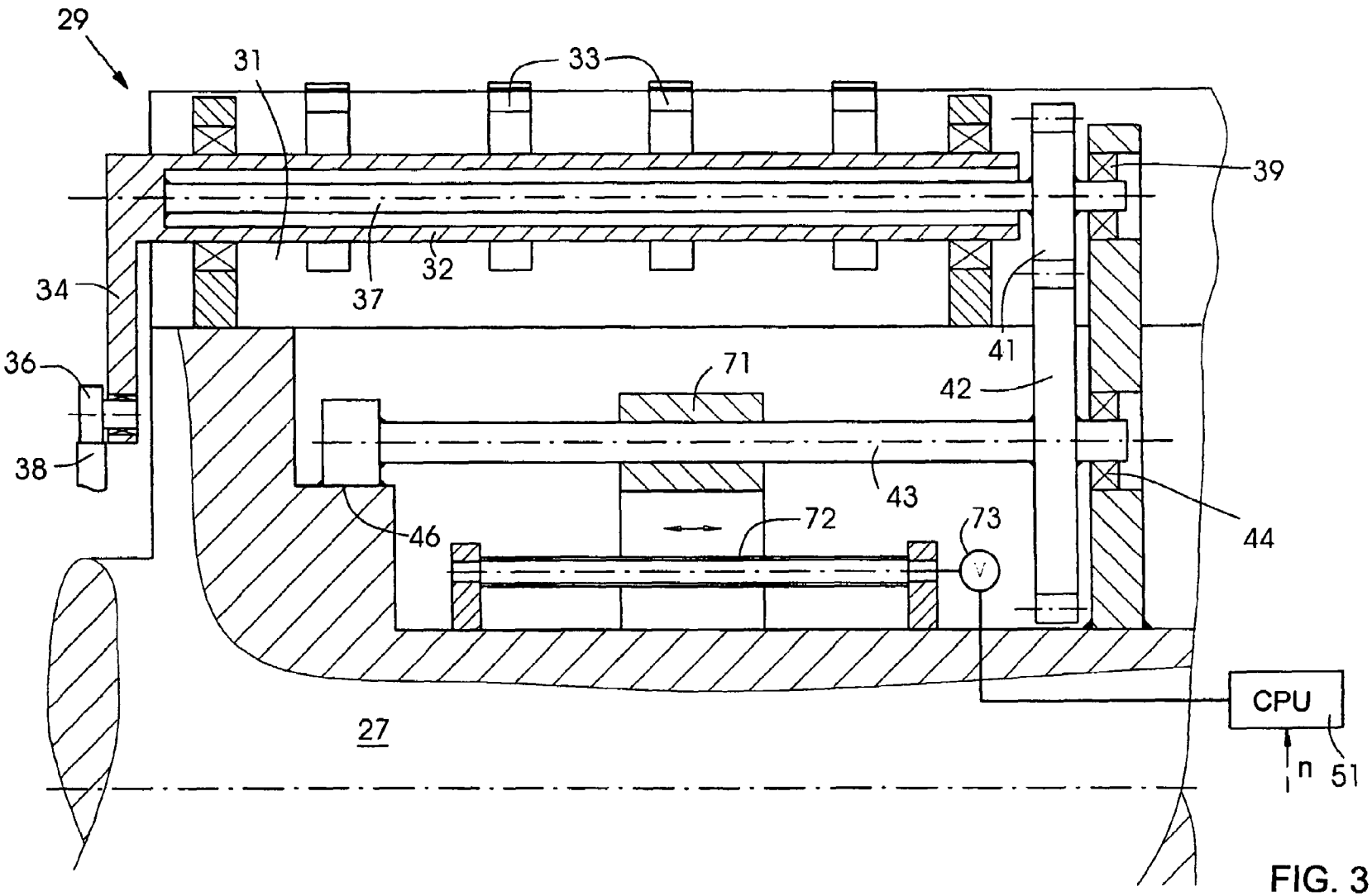
FIG. 3 is a diagrammatic cross-sectional view of a third exemplary embodiment of a way to change the spring stiffness of the gripper system according to the invention.

In a third exemplary embodiment, according to FIG. 3, provision is made to make the stiffness of the entire spring system variable by changing the twistable length of the torsion spring rod 43 as a function of the rotational speed of the sheet-processing machine. The torsion spring rod 43, formed as a square, is, in this case, surrounding coaxially with a clearance fit by a holder 71 that can be moved axially. The holder 71 is mounted so as to be fixed against rotation and is driven by a threaded bore mechanism 72 driven by a motor 73 that can be driven by the machine controller 51.

A displacement of the holder 71 in the direction of the fixed clamping device 46 lengthens the twistable length of the torsion spring rod 43, which means that the spring stiffness of the entire gripper system decreases and the pressing force of the control roller 36 on the control cam 38 is reduced. As the machine rotational speed increases, the holder 71 is moved in the opposite direction, which means that the spring stiffness of the gripper system is increased and the pressing force of the control roller 36 on the control cam 38 increases.

Figure 4:
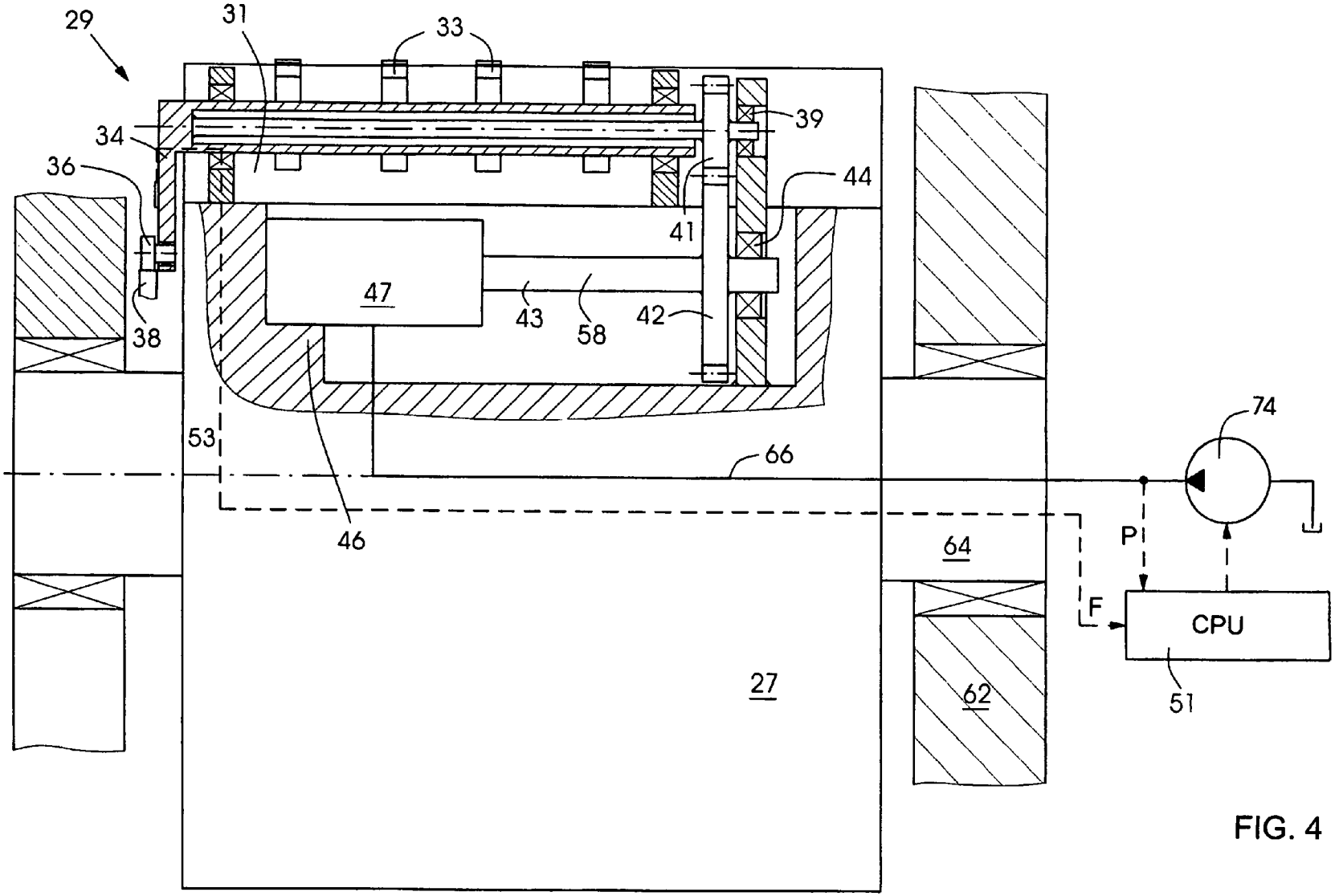
FIG. 4 diagrammatic cross-sectional view of a fourth exemplary embodiment according to the invention with regulated pressing force.

In a fourth exemplary embodiment according to FIG. 4, provision is made to dispose, on the control lever 34, a force sensor, for example, a strain gauge (DMS) 74, which is connected to the control computer 51 and determines the pressing force with which the control roller 36 is pressed onto the control cam. By using predefined data in the form of characteristic curves or formulas, the control computer 51 uses the measured data to determine the actuating values for the actuator 47.

This application claims the priority, under 35 U.S.C. § 119, of German patent application No. 10 2004 014 868.6, filed Mar. 26, 2004; the entire disclosure of the prior application is herewith incorporated by reference.

We claim:

1. An apparatus for adapting a pressing force of a control roller on a control cam, comprising:

a prestressed spring having a force, said force of said spring to be set as a function of a rotational speed of a sheet-processing machine, said spring being a plurality of torsion spring rods disposed parallel to one another and operatively connected one another; and the control roller being part of a cam-controlled gripper system in which said torsion spring rods, apply the pressing force.

2. The apparatus according to claim 1, wherein:

said torsion spring rods have a prestress; and an actuator is connected to said torsion spring rods and sets said spring force by changing said prestress of said torsion spring rods.

3. The apparatus according to claim 1, wherein:

said torsion spring rods have a spring stiffness; and a stiffening element is connected to one of said torsion spring rods and sets said spring force by changing said spring stiffness of said one of said torsion spring rods.

4. The apparatus according to claim 3, wherein:

said stiffening element has a holder surrounding said one of said torsion spring rods; and said holder is secured against rotation and displaced axially.

5. The apparatus according to claim 4, further comprising an actuating motor connected to said stiffening element and displacing said stiffening element along said one of said torsion spring rods.

6. The apparatus according to claim 1, further comprising a gear wheel coupling operatively connecting said torsion spring rods to one another.

7. The apparatus according to claim 6, further comprising an actuator connected to at least one of said torsion spring rods for rotating said at least one of said torsion spring rods.

8. The apparatus according to claim 7, wherein said actuator has a hydraulically actuated operating cylinder.

9. The apparatus according to claim 8, wherein:

said operating cylinder has an operating chamber; and a stationary pump to be driven by a control computer as a function of the rotational speed of the sheet-processing machine is pressurizes said operating chamber.

10. The apparatus according to claim 9, further comprising:

a cylinder bearing said torsion spring rods;

said operating cylinder having an operating chamber; and a hydraulic pump pressurizing said operating chamber and being driven by said cylinder bearing said torsion spring rods.

11. The apparatus according to claim 10, wherein:

a first feed line connects said pump to said operating chamber;

an oil reservoir is fixed to said cylinder bearing said torsion spring rods;

a second feed line connects said pump to said oil reservoir; and a restrictor connects said first feed line to said second feed line.

12. In a sheet-processing machine operating with a rotational speed and having a control roller and a control cam, an apparatus for adapting a pressing force of the control roller on the control cam, comprising:

a prestressed spring having a force, said force of said spring being set as a function of the rotational speed of the sheet-processing machine, said spring being a plurality of torsion spring rods disposed parallel to one another and operatively connected one another; and the control roller being part of a cam-controlled gripper system in which said torsion spring rods, apply the pressing force.

13. A sheet-processing machine, comprising:

a sheet-processing assembly operating with a rotational speed, said sheet-processing assembly having a control roller and a control cam, said control roller contacting said control cam with a pressing force; and an apparatus for adapting said pressing force of said control roller on said control cam, said adapting apparatus having a prestressed spring having a force, said force of said spring being set as a function of said rotational speed of said sheet-processing assembly, said spring being a plurality of torsion spring rods disposed parallel to one another and operatively connected one another, and said control roller being part of a cam-controlled gripper system in which said torsion spring rods, apply said pressing force.

* * * * *